United States Patent [19]

Vernon

[11] 4,173,043

[45] Nov. 6, 1979

[54] WIND RESISTANT FLOATABLE POOL COVER AND MANUFACTURE THEREOF

[75] Inventor: William C. Vernon, Walnut Creek, Calif.

[73] Assignee: Imperial Wax and Chemical Company, Walnut Creek, Calif.

[21] Appl. No.: 900,176

[22] Filed: Apr. 26, 1978

[51] Int. Cl.[2] ..... E04H 3/19

[52] U.S. Cl. ..... 4/172.12; 9/11 A

[58] Field of Search ..... 4/162, 172, 172.12–172.14, 4/173 R, 154; 114/125; 160/354; 9/340–342, 2 A, 11 A; 220/217, 219, 216

[56] References Cited

U.S. PATENT DOCUMENTS

| | | | |
|---|---|---|---|
| 1,427,526 | 8/1922 | Frahm | 114/125 |
| 2,173,993 | 9/1939 | Amdur | 4/154 |
| 2,870,455 | 1/1959 | Reeves | 4/172.12 |
| 2,883,676 | 4/1959 | Kwake | 160/354 X |
| 3,072,920 | 1/1963 | Yellott | 4/172.12 |
| 3,092,854 | 6/1963 | Manhart | 9/11 A |
| 3,676,880 | 7/1972 | Kwake | 4/172.12 |
| 3,747,131 | 7/1973 | Koliomichalis | 4/172.12 |
| 3,748,664 | 7/1973 | Morita | 4/172.14 |
| 3,872,522 | 3/1975 | Bennett et al. | 4/172.12 |
| 3,893,443 | 7/1975 | Smith | 4/172.12 X |
| 3,916,457 | 11/1975 | Morita | 4/172.12 |
| 4,022,187 | 5/1977 | Roberts | 4/172.12 X |
| 4,079,726 | 3/1978 | Voelker | 4/172.12 X |
| 4,082,081 | 4/1978 | McColgan | 4/172.12 X |
| 4,094,021 | 6/1978 | Rapp | 4/172.12 |
| 4,139,117 | 2/1979 | Dial | 4/172.12 X |

FOREIGN PATENT DOCUMENTS

| | | | |
|---|---|---|---|
| 2638192 | 3/1978 | Fed. Rep. of Germany | 4/172.12 |

*Primary Examiner*—Stuart S. Levy
*Attorney, Agent, or Firm*—Phillips, Moore, Weissenberger, Lempio & Majestic

[57] ABSTRACT

A floatable cover for use with an outdoor pool containing liquid which substantially prevents liquid evaporation and heat loss. The cover edges include a channel which extends along the edges, and means for admitting liquid into the channel, such as orifices, so that the liquid-filled channel increases resistance to wind lift. A method of manufacture for the cover is disclosed.

7 Claims, 6 Drawing Figures

WIND RESISTANT FLOATABLE POOL COVER AND MANUFACTURE THEREOF

BACKGROUND OF THE INVENTION

1. Field of the Invention

This invention relates to pool covers, and more particularly to swimming pool covers which are floatable upon the entire water surface.

2. Prior Art

A variety of pool covers are known to the art. Prior to the rising concern for energy conservation in recent years, covers for pools were primarily designed to prevent dirt, leaves and so forth from entering the pools during periods of filled or drained non-use. Such covers often were designed to entirely cover the pool above the water surface, and often were held in place by being lashed along the pool wall or about the pool exterior.

Such covers have been found to be inadequate, particularly for large, community swimming pools, in preventing substantial heat loss and water evaporation. As concern has grown for reducing the significant amount of energy required to heat swimming pools, some pools have converted to solar heating which further increases the need for a pool cover construction which will substantially prevent heat loss and water evaporation.

Among some recent types of pool covers are those which utilize light weight, buoyant water impervious materials to provide a swimming pool cover which floats upon the water surface yet which is easily removed. Such pool covers are taught, for example, by U.S. Pat. Nos. 3,748,664 and 3,916,457. However, the covers disclosed by these patents are designed primarily to prevent water evaporation and hence undesirable humidity in an indoor swimming pool enclosure. The light weight of such covers incurs the serious problem, if used outdoors, in that a sufficiently brisk wind can lift or crumple parts of the cover by peeling back the cover edges which are held upon the water only by the relatively weak water-to-cover surface force. This lack of wind resistance is especially acute when covers are designed for large, institutional swimming pools whose size often requires several covers for complete pool coverage.

Accordingly, it is an object of the present invention to provide a buoyant pool cover which substantially prevents liquid evaporation and heat loss.

It is another object of the present invention to provide a floatable cover which has increased resistance to wind lift in outdoor use, yet which is easily removed from the pool.

It is a further object of the present invention to provide a floatable cover with a strengthened edge to prevent tearing thereof.

SUMMARY OF THE INVENTION

The present invention provides a cover for use with an outdoor pool containing liquid comprising buoyant blanket means, channel means, and means for admitting liquid into the channel means. The blanket means prevents liquid evaporation and heat lost when floated upon the pool, and carries the channel means which extends along the blanket means peripheral edge. The liquid admitting means permits liquid to be admitted into the channel means for increasing resistance to wind lift.

The present invention also concerns a method for manufacturing a floatable outdoor pool cover whose peripheral edge has increased resistance to wind lift. The manufacturing method comprises forming a blanket member from buoyant, flexible, liquid impervious material so that a first peripheral edge of the blanket member is substantially of a predetermined shape and larger than a predetermined size, convoluting a blanket member portion to form at least one fold in the blanket member, and securing the fold.

DETAILED DESCRIPTION OF THE PREFERRED EMBODIMENTS

Figure 1:
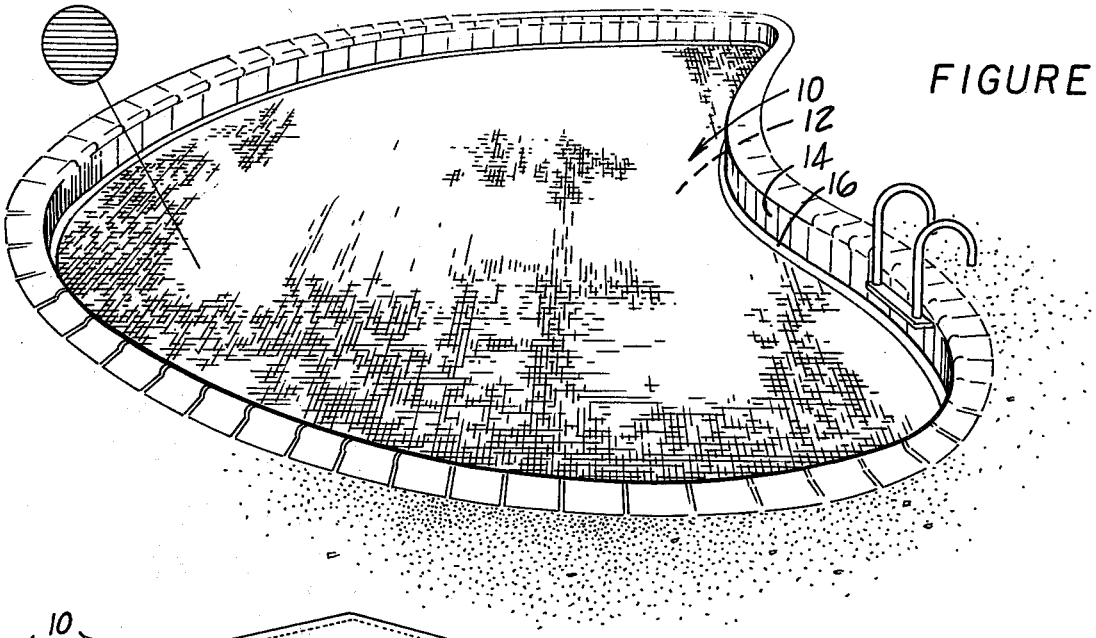
FIG. 1 is a perspective view of the invention in use with a pool.

As illustrated to FIG. 1, a cover 10 is intended for use by floating upon the liquid surface 12 of an outdoor pool 14. As herein further described, water is the liquid to which reference is made. However, it should be understood that the term "water" includes salt water or other liquids with a density not substantially different than that of water.

Figure 2:
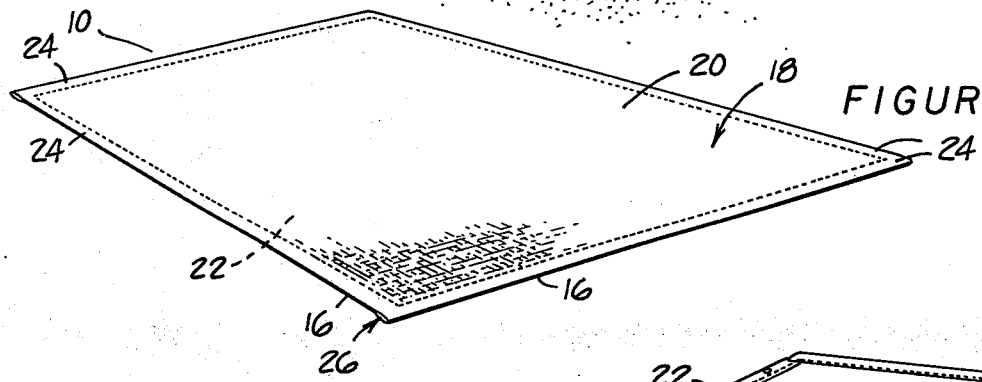
FIG. 2 is a perspective top view of the invention, with a different shape from that of FIG. 1.
Figure 3:
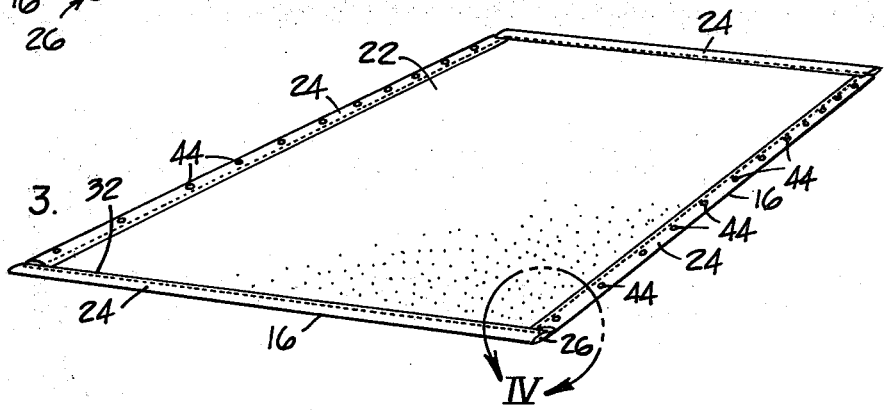
FIG. 3 is a perspective bottom view of the invention as in FIG. 2.

The cover 10 may take a variety of shapes, such as the free-form configuration of FIG. 1, or the regular polygonal configuration illustrated by FIG. 2. Regardless of the particular configuration, it is preferred that a peripheral edge 16 of cover 10 substantially conforms to the pool 14 configuration so that the cover 10 covers the entire water surface 12.

Turning to FIG. 2, the cover 10 comprises blanket means 18 which prevents water evaporation and heat loss from pool 14. The blanket means 18 must be formed from a buoyant and water impervious material which is also preferably substantially flat and flexible. The material from which blanket means 18 is made preferably comprises a relatively dark colored, water impervious upper portion 20, and a light colored, buoyant lower portion 22.

An excellent material for making blanket means 18 is a laminate formed as follows. Upper portion 20 may be a woven, high density ($10\times10$ count/in$^2$) polyethylene which is ultra-violet stabilized and which provides high tear strength. The woven polyethylene is made water impervious by laminating thin (1.5 mil) polyethylene sheet on both sides. Upper portion 20 is preferably a relatively dark colored material, illustrated in FIG. 2 by shading for the color blue.

Lower portion 22 is preferably made from any suitable foamed plastic so long as the foamed plastic remains buoyant when floated upon a pool. Suitable foamed materials are known to the art and, in general, are those plastics which have a closed cell construction so that the foamed plastic does not become waterlogged during extended periods of contact with water. A thickness of as thin as about $\frac{1}{8}$ inch has been found to be quite satisfactory for providing a lightweight buoyant lower portion 22.

When upper and lower portions 20, 22 are of materials as described above, they are preferably laminated one to the other to form blanket means 18. Such laminated materials are commercially available from the Dow Chemical Co.

Channel means 24 is carried by blanket means 18 along peripheral edge 16 of cover 10. As will be hereinafter further described, peripheral edge 16 is herein defined as a second peripheral edge 16 resulting from the preferred manufacturing steps which include a first peripheral edge 32. Channel means 24 must extend outwardly from the horizontal plane defined by blanket means 18, and extend along and be substantially parallel to peripheral edge 16, a sufficient distance as to substantially surround blanket means 18. It is preferred that channel means 24 continuously extends along the entire peripheral edge 16; however, it should be understood that channel means 24 could be carried by and substantially surrounding blanket means 18 in the form of discrete channel members.

Figure 4:
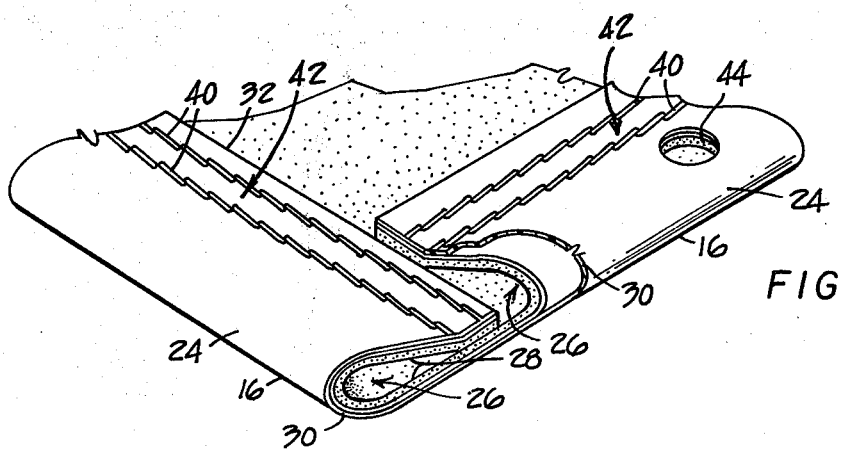
FIG. 4 is a detail of the invention as in FIG. 3, partially broken away.

Channel means 24 includes a generally tear-drop shaped cavity 26, best seen in FIG. 4. Cavity 26 is formed by two walls 28, one of which substantially lies in the plane defined by upper portion 20, the other of which lies slightly below the plane defined by the lower portion 22.

Channel means 24 preferably includes a strengthening member 30 which surrounds the exterior of walls 28. Strengthening member 30 is also preferably formed of a water impervious material such as that described for upper portion 20.

The best mode contemplated for forming channel means 24 is that blanket means 18 will initially be substantially of a predetermined shape, but larger than a predetermined size. The predetermined size will normally be so as to substantially cover the entire water surface 12, When blanket means 18 is of the predetermined size, it will define the resultant, or second peripheral edge 16. That is, when blanket means 18 is of the original, larger size, it defines first peripheral edge 32.

Figure 5:
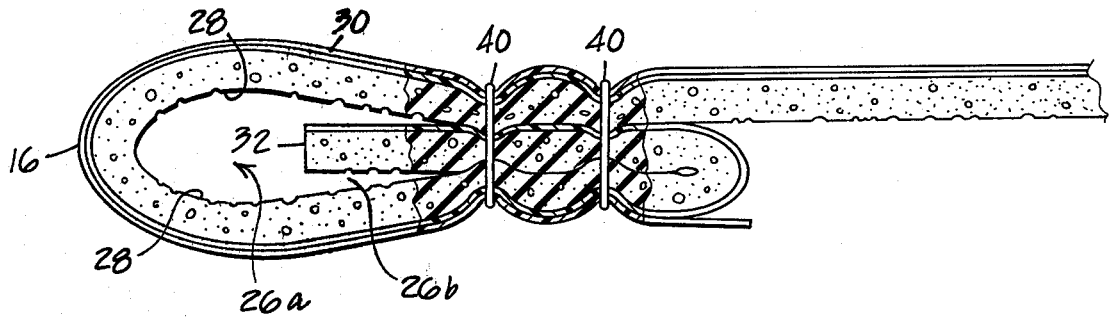
FIG. 5 is a cross-sectional view illustrating a particular aspect of the invention.

As best illustrated by FIG. 5, first peripheral edge 32 may be convoluted so as to form a double fold 36 wherein inner part of double fold 36 comprises cavities **26*a* and 26*b* with the outer portion of double fold 36 comprising walls 28**.

Returning to FIG. 4, the walls 28 of cavity 26 are bounded on the more horizontally outward side of fold 36 by second peripheral edge 16 and on the more horizontally inward side of fold 36 by fold securing means 40. Thus, securing means 40 is a spaced distance from second peripheral edge 16.

Securing means 40 preferably comprises sewing machine stitches, such as stitches formed by interlocking stitch methods or chain stitch methods. When securing means 40 comprises stitches, the stitches pass entirely through all layers of material comprising fold 36, as best illustrated in FIG. 5.

The inventive cover preferably includes means for admitting water into cavity 26. When the securing means 40 comprises stitches, the interstices between the stitches will provide the means for admitting water, illustrated by dotted arrow 42 of FIG. 4. Since however, stitches will normally admit water at a slow rate, it is preferred that the water admitting means also comprises a plurality of orifices 44 in the channel means 24. Orifices 44 pass through the wall 28 which lies slightly below the plane with respect to lower portion 22. Orifices 44 function to rapidly admit water 12 when cover 10 is initially floated upon pool 14, as well as to rapidly permit water to drain from the channel means 24 when cover 10 is removed from pool 14. The entry of water into the channel means 24, via cavity 26, results in a cover 10 whose peripheral edge 16 substantially increases resistance to wind lift.

Figure 6:
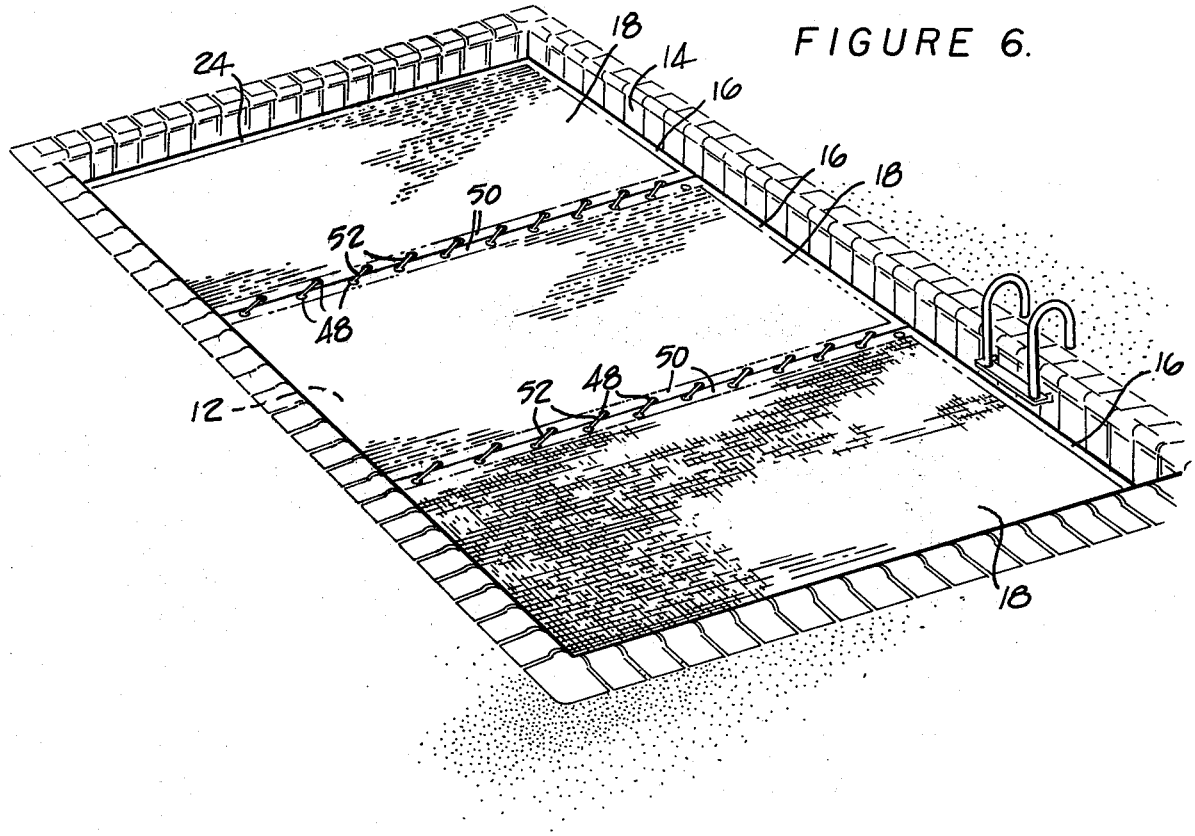
FIG. 6 is a perspective top view of the invention illustrating an embodiment of the invention.

When cover 10 is designed for use with large pools, such as institutional swimming pools, it is more practical that blanket means 18 comprises a plurality of blanket means 18, since a single blanket means 18 would be too unwieldly and heavy for covering the pool and for the subsequent removal of the cover. Referring to FIG. 6, when a plurality of blanket means 18 are used in a cover 10 of the present invention, the blanket means 18 form strips across portions of the pool so that the blanket means 18 together cover the entire water surface of the pool. Cover 10 then preferably includes means for fastening the blanket means together along the portions 50 of peripheral edge 16, wherein portions 50 are the contiguous parts of blanket means 18 one to another.

The fastening means may comprise, for example, grommets 48 which pass entirely through and between upper portion 20 and lower portion 22 along portions 50.

Such a plurality of blanket means 18 are normally wound on a roll or rolls rotatably mounted adjacent one side of pool 14. Such rolls are known to the art, and are not herein illustrated. However, when covers 10 of the present invention have been wound on such rolls, the plurality of blanket means 18 may be lashed together by conventional means through corresponding grommets 48, such as rope 52, as the rolls are unwound. It is particularly desirable that the plurality of blanket means 18 include strengthening member 30 to prevent tearing of channel means 24 or disengagement of grommets 48 therefrom.

In summary, the present invention provides a cover which prevents water evaporation, heat loss, and resistance to wind lift when floated upon an outdoor pool. Although particularly useful for swimming pools, it should be understood that the inventive cover can be utilized with fish ponds, water conservation and farm irrigation lakes, and the like.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features here set forth, and which fall within the scope of the invention and the limits of the appended claims.

What is claimed is:

1. A cover for use with an outdoor pool containing liquid comprising:

means for blanketing a pool to prevent liquid evaporation and heat loss, the blanket means being and of a construction sufficient to be buoyantly floatable upon the liquid surface of the pool;

said blanket means comprising a relatively dark colored, water impervious upper portion and a light colored, buoyant lower portion; said blanket means having an integral peripheral edge folded upon itself and secured thereto to form integral peripheral channel means on the blanket for channeling water about the peripheral edge of said blanket; and means on the underside of said channel means for rapidly admitting liquid into and for self-filling the channel means when the blanket means is floated upon the pool for increasing resistance to wind lift, the channel means being of a construction sufficient to be buoyantly held substantially horizontally outwardly of the blanket means when the channel means is filled with liquid and the blanket means is floating upon the liquid surface of the pool.

2. The cover of claim 1 wherein the liquid admitting means defines a plurality of orifices in the channel means.

3. The cover of claim 1 wherein the channel means extends along substantially the entire peripheral edge.

4. The cover of claim 3 further comprising:

a strengthening member exterior to and surrounding the channel means.

5. The cover of claim 3 wherein the blanket means comprises a plurality of blanket means, the blanket means together defining the peripheral edge.

6. The cover of claim 3 or 5 wherein the peripheral edge substantially conforms to the configuration of said pool so that the blanket means substantially covers the entire liquid surface of said pool.

7. The cover of claim 5 wherein the blanket means includes means for fastening the blanket members together; and a strengthening member exterior to and surrounding the channel means.

* * * * *